United States Patent [19]

Morris et al.

[11] Patent Number: 4,626,735

[45] Date of Patent: Dec. 2, 1986

[54] INCANDESCENT LAMP HAVING TWO LEAD-IN CONDUCTORS SEALED WITHIN ONE END AND INCLUDING EXPANSION MEANS

[75] Inventors: Merle E. Morris; Stephen P. Senft, both of Lexington, Ky.

[73] Assignee: GTE Products Corporation, Stamford, Conn.

[21] Appl. No.: 768,582

[22] Filed: Aug. 23, 1985

[51] Int. Cl.[4] ..... H01J 5/48; H01J 5/50

[52] U.S. Cl. ..... 313/275; 313/315; 313/274; 313/318; 313/279; 313/269; 313/285; 313/579; 313/341

[58] Field of Search ..... 313/331, 341, 318, 271, 313/274, 275, 279, 579, 315, 316, 269, 285

[56] References Cited

U.S. PATENT DOCUMENTS

| | | | |
|---|---|---|---|
| 3,493,808 | 2/1970 | McClusky et al. | 313/274 |
| 3,760,217 | 9/1973 | Martin et al. | 313/276 |
| 3,912,960 | 10/1975 | Danko | 313/222 |
| 4,442,374 | 4/1984 | Morris et al. | 313/316 |

*Primary Examiner*—David K. Moore
*Assistant Examiner*—M. Razavi
*Attorney, Agent, or Firm*—Lawrence R. Fraley

[57] ABSTRACT

A tungsten-halogen lamp including a tubular quartz envelope wherein both of the lead-in conductors designed for providing electrical energy to the lamp's coiled filament are strategically positioned within a single, press-sealed end portion of the lamp's envelope. Electrical connections to the lamp may thus be provided at only one end thereof to thereby facilitate positioning and connection of the lamp within a photocopier or similar machine. The lamp is suited for high wattage applications (i.e., about two-hundred watts per linear inch of filament or greater) by the utilization of an expansion coil section which is provided in one of the lamp's two lead-in conductors to prevent bowing of the lead-in conductor and its quartz sleeve. This coil section enables the conductor to expand during the high temperatures encountered when the lamp is operated at such high wattages.

5 Claims, 2 Drawing Figures

INCANDESCENT LAMP HAVING TWO LEAD-IN CONDUCTORS SEALED WITHIN ONE END AND INCLUDING EXPANSION MEANS

TECHNICAL FIELD

This invention relates generally to electric incandescent lamps, and more particularly to tubular lamps having axially extending coiled filaments therein. Still further, the invention relates to tungsten-halogen lamps of this type wherein the opposing ends of the tubular envelope are press-sealed.

CROSS REFERENCE TO COPENDING APPLICATIONS

Copending applications include Ser. No. 575,965, entitled "incandescent Lamp Having Two Lead-In Conductors Sealed Within One End Thereof" (Inventors: Merle E. Morris et al), and Ser. No. 691,965, entitled "Incandescent Lamp Having Two Lead-In Conductors Sealed Within One End Thereof" (Inventors: Merle E. Morris et al.). Ser. No. 575,965 was filed Feb. 1, 1984 and Ser. No. 691,965 was filed Jan. 16, 1985. Both are assigned to the same assignee as the present invention.

BACKGROUND

Examples of tungsten-halogen incandescent lamps having opposed press-sealed end portions are known in the art. Examples are described and illustrated in U.S. Pat. Nos. 3,392,299 (Kern), 3,443,144 (Fresse, Jr.) 3,602,761 (Kimball), 3,943,395 (Huston et al), and 4,359,665 (Morse et al), all of which are assigned to the same assignee as the instant invention. It will be understood from the following that this invention is particularly adapted to lamps of the above type which are especially suited for use in photocopiers. One particular example is shown and described in the aforementioned U.S. Pat. No. 3,943,395.

In U.S. Pat. No. 3,943,395, there is described a lamp including a tubular glass envelope having opposed press-sealed end portions, each of which contain the respective lead-in conductors which, when connected to the photocopier's power source (i.e., 110 VAC), provides electrical energy to the lamp's filament to cause activation thereof. As shown in this patent, lamps of this variety typically include an end cap of ceramic or the like material located on each of the press-sealed ends. These end caps are inserted within the corresponding connectors within the photocopier and connection is made at each end. One particular problem in such an arrangement is that many photocopier machines provide little accessibility at one of these connector locations, in effect, creating a "blind side". Providing positive electrical connection at these locations has thus proven somewhat difficult.

In the aforementioned Application Ser. No. 575,965, there is defined a lamp which overcomes this problem. It has been determined, however, that a lamp according to the design taught in Ser. No. 575,965 is operable only at wattage levels less than one hundred watts per inch. At wattages above this level, excessive heating of the contained inner lead and glass tubing member in which this lead is oriented has occurred. Such heating has in turn caused the tubing member to disfigure (i.e., melt), which in turn can cause the lamp to become inoperative. Accordingly, in Ser. No. 691,695, a lamp was defined wherein the inner lead and glass tubing member were located externally of the coiled filament supports, thus assuring a minimum spacing between the filament and these elements. Excessive heating was substantially prevented. In accordance with the teachings of the instant invention, a means is provided for preventing such excessive heating (and accompanying bowing of the tubing and inner lead) without the requirement of external placement as described in Ser. No. 691,695. It is understood, however, that the teachings of this invention are also applicable to and can be successfully utilized in the lamp defined in Ser. No. 691,695.

It is believed, therefore, that an improved tubular incandescent lamp of the type described in Ser. No. 575,965 wherein all electrical connections necessary to accomplish activation of the lamp are made at only one end thereof and which enables operation of the lamp at wattage levels substantially above those in Ser. No. 575,965 would constitute a significant advancement in the art. As such, this lamp would only make it necessary to provide a suitable non-electrical connector or the like in this "blind side" region of the photocopier, whereupon mere insertion of such a lamp therein would be possible without requiring electrical connection thereat. Equally significant, such a lamp would be substantially more versatile than that defined in Ser. No. 575,965 because it could be utilized not only in those present applications using said lamp but also in those situations wherein substantially greater wattages (i.e., greater than two hundred watts per linear inch) are demanded without possibly adversely affecting the operation of the lamp. The instant invention is particularly adaptable for use in such applications without the requirement for extensive modification to the photocopier machine.

DISCLOSURE OF THE INVENTION

It is, therefore, an object of this invention to further enhance the incandescent lamp art and particularly that art involving incandescent lamps having elongated tubular envelopes wherein the filament axially extends therethrough.

It is another object of the this invention to provide an improved incandescent lamp wherein said lamp is readily adapted for use within a photocopier machine or the like.

It is an even more particular object of this invention to provide a lamp of the type defined in copending Application under Ser. No. 575,965 wherein the lamp can be readily utilized in high wattage applications.

Still another object of the invention is to provide an improved incandescent lamp possessing the features defined herein which can be produced at relatively low cost and on a mass production basis.

In accordance with one aspect of this invention, there is defined an improved incandescent lamp which includes a tubular envelope having first and second press-sealed end portions, a coiled filament extending longitudinally through the envelope's interior, at least one coiled filament support member within the envelope, and first and second lead-in conductors each of which extend within the envelope and are electrically connected to a respective one of the filament's ends. Both lead-in conductors are positioned within the first press-sealed end of the tubular envelope in a spaced-apart relationship such that electrical connections for providing electrical energy to the lamp's filament can be attached to the lamp at only the first press-sealed end portion of the envelope. The inner portion of the second lead-in conductor is positioned within a tubular insulative member. Means is provided for preventing bowing of the second lead-in conductor and insulative member when the lamp is operated at high temperatures (i.e., above about 100 watts per inch of filament length).

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
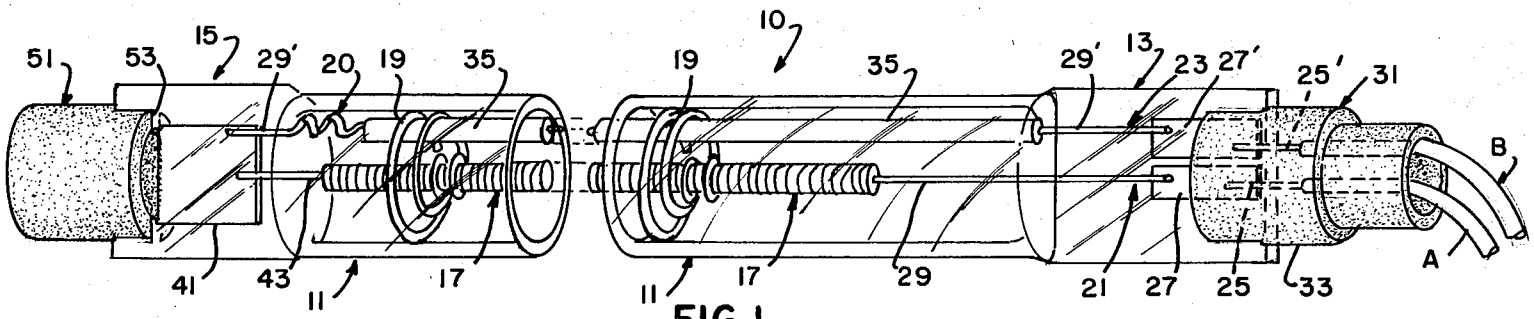
FIG. 1 is a side view, partly in section, of the instant invention.

With particular attention to FIG. 1, the lamp 10 illustrated therein, similar in many respects to the lamp defined in the aforementioned copending Application Ser. No. 575,965, comprises a tubular envelope 11 of vitreous material having first and second press-sealed end portions 13 and 15, respectively. Ends 13 and 15, as illustrated, are located at opposite ends of the elongated tubular envelope and are thus substantially spaced apart by the interior (hollow) portion of the envelope. Formation of these press sealed end portions is accomplished utilizing pressing operations and apparatus known in the art and further description is not believed necessary. Because envelope 11 will attain elevated temperatures during operation of lamp 10, it is preferred that the material for the envelope possess a relatively high melting point. Examples include fused silica, or quartz, or Vycor (cotaining approximately ninety-six percent silica). High melting point glasses such as borosilicate or aluminosilicate may also be suitable.

Lamp 10, as indicated previously, is of the tungsten-halogen variety. As such, envelope 11 contains therein a halogen additive, such as iodine or bromine, which functions as a regenerative getter to return to the lamp's axially extending coiled tungsten filament 17 quantities of tungsten which may be vaporized therefrom during lamp operation. Envelope 11 preferably also contains an inert gas such as nitrogen, argon, krypton or xenon at substantial pressure (i.e., greater than one atmosphere).

Filament 17, as stated, is of tungsten material and, as illustrated, is substantially centrally disposed within the interior of envelope 11. Filament 17 is of coiled configuration. By this is meant that the filament may comprise a singular elongated coiled element or, alternatively, what is known in the art as a coiled-coil element. Examples are illustrated in the aforementioned patents (i.e., U.S. Pat. No. 3,392,299). Supporting the filament at preselected points along the length thereof are a plurality of support members 19 which, as illustrated, each comprise a coiled element having one end would about (and thus secured to) the filament and the other end (of greater diameter) positively engaging an interior wall of envelope 11. As will be described further below, each coiled support member 19 is also located about (thus partly surrounding) an insulative support member (35). The number of filament support members 19 utilized in lamp 10 is dependent on the overall length of envelope 11 (and, therefore, filament 17). In one example of the invention, a total number of sixteen support members 19 was utilized, each of tungsten wire having an outer diameter of about 0.272 inch. In this same example, envelope 11 possessed an overall length of about nineteen inches and tungsten filament 17 possessed an overall length of about eleven and one-half inches. Of this total envelope length, each of the press-sealed end portions 13 and 15 possessed an overall length of slightly greater than one-half inch. The preferred number of coiled filament support members 19 is within the range of about five to about twenty for most applications, although this number may of course readily vary from this range.

Although it has been stated that one material for support members 19 is tungsten, it is within the scope of this invention to utilize other materials, such as an alloy of tungsten and rhenium (about ninety-seven percent tungsten and three percent rhenium). This latter material is described in the aforementioned U.S. Pat. No. 3,392,299.

Prior art lamps of the aforementioned variety, including those illustrated in the above patents, typically include means for providing electrical connection to the lamp's filament each located within each of the opposing ends of the lamp's elongated envelope. As stated, such an arrangement necessitates providing electrical contact at a location somewhat difficult to reach in many photocopier machines. Accordingly, the lamp as defined in Ser. No. 575,965 provides means for electrically connecting the lamp described therein at only one end thereof to thus enable an individual positioning such a lamp within a photocopier to provide connection thereto in an effective, facile and relatively safe manner. As will be defined in greater detail below, the lamp of the instant invention constitutes an improvement over the lamp in Ser. No. 575,965 by providing means whereby the lamp's internal conductor (as well as the surrounding tubular member) does not become adversely affected (i.e., deformed) by the heat generated from the filament. Such deformation could render the lamp inoperative. Accordingly, the lamp of the instant invention is able to operate at significantly greater wattage levels (and corresponding higher filament temperatures) than the lamp in Ser. No. 575,965. By way of example, wattage levels in excess of about two-hundred watts per linear inch (of filament) have been attained, in comparison to less than about one hundred watts per linear inch for the lamp defined in Ser. No. 575,965.

Lamp 10 is illustrated in FIG. 1 as including a pair of lead-in conductors 21 and 23 which are each securely positioned in a spaced-apart (and, therefore, electrically insulated) manner within the first press-sealed end portion 13 of tubular envelope 11. It is thus possible to provide connection to only end 13 (and thus to both conductors 21 and 23) to achieve activation of filament 17.

The first lead-in conductor, hereinafter referred to by the numeral 21, includes an outer portion 25, preferably of molybdenum wire having a diameter of about 0.030 inch, an intermediate foil portion 27, also preferably of molybdenum and of the rectangular configuration illustrated, and an inner portion 29, preferably of tungsten wire having a diameter of about 0.025 inch. Intermediate foil 27 is hermetically sealed within the first press-sealed end 13 during the press-sealing operation after having both inner and outer portions affixed (i.e., welded) thereto. As illustrated, outer portion 25 extends exteriorly from envelope 11 and is thus readily adapted for being electrically connected to an external electrical connection (contact terminal A). Inner portion 27 extends interiorly of envelope 11 and is connected to the end of filament 17 nearest the first press-sealed end 13. This connection may be accomplished by winding the coil filament about a predetermined length of the end of inner portion 29 and thereafter welding these two elements.

Second lead-in conductor 23, designed for being electrically connected to the opposing end of filament 17, also includes an outer portion 25', preferably of similar diameter molybdenum wire as outer portion 25, an intermediate rectangular-shaped foil portion 27' similar in size to foil 27, and an inner portion 29'. As illustrated, intermediate foil portion 27' is also hermetically sealed within the first press-sealed end 13 and has connected thereto (also preferably by welding) the end segments of outer and inner portions 25' and 29', respectively. Outer portion 25', as illustrated, is designed for being electrically connected to a second electrical connection (contact terminal B). Both contact terminals A and B can be positioned within an insulative (e.g., ceramic) end cap member 31 to provide these necessary connections. Cap member 31 preferably includes an enlarged cylindrical portion 33 possessing a slot for the like therein. This slot (not shown) is specifically designed for having the flattened (rectangular in cross-section) end 13 inserted therein.

Inner portion 29' of second lead-in conductor 23, like inner portion 29 of the first lead-in conductor, also is preferably in the form of a conductive wire. Unlike inner portion 29, however, inner portion 29' is preferably of molybdenum wire having a diameter of about 0.025 inch and extends longitudinally through the interior of envelope 11 and into the opposing second press-sealed end portion 15. Inner portion 29' is also located substantially parallel to the coiled filament 17 and spaced therefrom. In addition, inner portion 29' is positioned substantially within a tubular, insulative member 35. In one embodiment, member 35 comprised a tubular glass member of cylindrical configuration having an outer diameter of about 0.080 inch. Insulative member 35 passes through the coiled support members 19 in the manner shown and may or may not contact the interior surfaces of envelope 11. As mentioned before, when operating temperatures exceed 75–100 watts per inch, the second lead-in conductor will have a tendency to grow in length which in turn can cause bowing of the conductor and its quartz sleeve 35. The instant invention overcomes this disadvantage by providing the inner portion 29' of the lead-in conductor 23' with a coiled expansion section 20. This expansion section is located at the point where lead-in conductor 23' exits from sleeve 35 adjacent the connection to foil member 41. Section 20, as shown, is of the same material as conductor 23, that being formable molybdenum. Although a coiled configuration is depicted, it is also within the scope of this invention to use a waveform shape or the like which occupies a single plane. In the lamp possessing the aforementioned dimensions, the outer surface of the tubular insulative member was located about 0.100 inch from the outermost surfaces of the cylindrical-shaped filament. Coiled section 20 also allows the sleeve 35 and second conductor 29' to maintain the desired space relationship within envelope 11. Wattages as high as six hundred watts per linear inch have been attained using the teachings of the instant invention.

Similar to the lamp defined in Ser. No. 575,965, inner portion 29' extends within the second press-sealed end portion 15 of envelope 11. As illustrated in FIG. 1, inner portion 29' is electrically connected to a foil element 41, preferably of molybdenum, which element has been hermetically sealed within end 15. Inner portion 29' is preferably connected thereto by welding. Electrical connection to the opposing end of filament 17 is provided by a conducting wire member 43 which is joined at one end to the foil element 41 within end 15 and at the other end is electrically connected to filament 17. This latter connection is preferably accomplished in the same manner described for inner portion 29. Conducting member 43 is preferably tungsten wire having an outer diameter of about 0.025 inch. In one embodiment, the foil element 41, of the rectangular configuration shown, possessed a length of about 0.375 inch, a width of about 0.163 inch and a thickness of only about 0.002 inch. The connections of inner portion 29' and conducting member 43 were made thereto prior to sealing of the foil element within end portion 15.

To facilitate positioning of lamp 11 within the photocopier designed for utilizing same, a ceramic end cap 51 is preferably used. Accordingly, it is only necessary in the respective photocopier to provide some means for accepting this component. Understandably, such a means can be of relatively simply design. End cap member 51 is also preferably of substantially cylindrical configuration and includes a slot 53 therein designed for having the flattened second press-sealed end portion 51 inserted therein.

Figure 2:
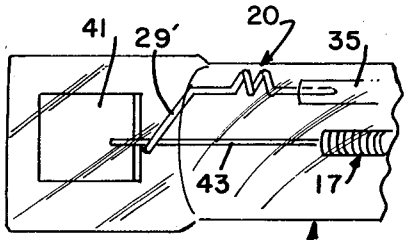
FIG. 2 is a partial side view of the invention, illustrating an alternate embodiment of the second lead-in conductor of the invention.

As an alternate embodiment possible for lead in conductor 23, the end part of inner portion 29' (FIG. 2) is bent such that it provides direct electrical connection to conducting wire member 43. Preferably, this connection is achieved by welding. It is thus only necessary to connect (e.g., by welding) the end of conducting member 43 to foil element 41, thereby facilitating assembly of this portion of the invention, as well as assuring positive electrical connection between inner portion 29' and member 43.

While there have been shown and described what are at present considered the preferred embodiments of the invention, it will be obvious to those skilled in the art that various changes and modifications may be made therein without departing from the scope of the invention as defined by the appended claims.

What is claimed is:

1. In an incandescent lamp including a long, small diameter, tubular envelope having first and second press-sealed end portion, a coiled filament extending longitudinally through the interior of said envelope, at least one filament support member located within said envelope for supporting said filament within said envelope at a location between the ends of said filament and first and second lead-in conductors each of said lead-in conductors extending within said envelope and electrically connected to a respective one of the ends of said coiled filament, both of said lead-in conductors being positioned within said first press-sealed end portion of said envelope in a spaced-apart relationship to thereby enable electrical connections for providing electrical energy sufficient to activate said filament to be attached to said incandescent lamp at only said first press-sealed end portion, said first lead-in conductor electrically connected to said end of said filament nearest said first press-sealed end portion of said envelope and said second lead-in conductor connected to said end of said filament nearest said second press-sealed end portion of said envelope, said second lead-in conductor including a conductive wire inner portion extending longitudinally through said interior of said envelope substantially parallel to said filament and extending within said second press-sealed end portion of said envelope, a singular foil element hermetically sealed within said second press-sealed end portion, and a conducting wire member electrically connected to said foil element within said second press-sealed end portion and extending within said envelope for being electrically connected to said end of said filament nearest said second press-sealed end portion, said lamp further including a tubular, electrically insulative member located within said interior of said envelope and extending substantially the entire length thereof, said insulative member passing through and engaged by said filament support member while being spaced from and substantially parallel to said coil filament, said conductive wire inner portion of said second lead-in conductor being positioned within said tubular insulative member, the improvement wherein said inner portion of said second lead-in conductor includes therein an expandable section of curvilinear configuration for substantially preventing bowing of said second lead-in conductor and said tubular insulative member when said lamp is operated at high temperatures.

2. The improvement according to claim 1 wherein said means for substantially preventing bowing comprises an expansion section of said lead-in second conductor.

3. The improvement according to claim 2 wherein said expansion section is comprised of formable molybdenum wire.

4. The improvement according to claim 2 wherein said expansion section is of a coil configuration.

5. The improvement according to claim 2 wherein said expansion section is of a waveform configuration.

* * * * *